US010773363B2

(12) United States Patent
Liao

(10) Patent No.: US 10,773,363 B2
(45) Date of Patent: Sep. 15, 2020

(54) ADJUSTABLE RATCHET WRENCH

(71) Applicant: Hung-Chiang Liao, Changhua County (TW)

(72) Inventor: Hung-Chiang Liao, Changhua County (TW)

( * ) Notice: Subject to any disclaimer, the term of this patent is extended or adjusted under 35 U.S.C. 154(b) by 291 days.

(21) Appl. No.: 16/050,214

(22) Filed: Jul. 31, 2018

(65) Prior Publication Data

US 2019/0099866 A1 Apr. 4, 2019

(30) Foreign Application Priority Data

Sep. 29, 2017 (TW) ..... 106133491 A

(51) Int. Cl.
*B25B 13/46* (2006.01)
*B25B 13/12* (2006.01)
*B25B 23/00* (2006.01)

(52) U.S. Cl.
CPC ..... *B25B 13/463* (2013.01); *B25B 13/12* (2013.01); *B25B 23/0007* (2013.01)

(58) Field of Classification Search
CPC ... B25B 13/463; B25B 13/48; B25B 23/0007; B25B 13/46; B25B 13/12; B25B 13/18
See application file for complete search history.

(56) References Cited

U.S. PATENT DOCUMENTS 4,838,132 A 6/1989 Pyles
7,997,168 B2 * 8/2011 Kinskey ..... B25B 13/16 81/63
8,266,987 B1 * 9/2012 Chern ..... B25B 13/463 81/60
8,555,751 B1 * 10/2013 Chern ..... B25G 1/00 81/63
8,950,295 B2 * 2/2015 Chiang ..... B25B 13/44 81/63
9,475,178 B2 * 10/2016 Pelletier ..... B25B 13/44
9,889,544 B2 * 2/2018 Chern ..... B25B 13/18
10,399,213 B2 * 9/2019 Wang ..... B25B 13/46
2014/0260818 A1 * 9/2014 Chiang ..... B25B 13/44 81/63
2014/0331823 A1 * 11/2014 Chiriac ..... B25B 13/44 81/63.1
2015/0251297 A1 * 9/2015 Chang ..... B25B 13/10 81/128
2018/0015593 A1 * 1/2018 Wang ..... B25B 13/463
2018/0043515 A1 * 2/2018 Zelniker ..... B25B 13/463
2018/0281159 A1 * 10/2018 Carnesi ..... B25G 1/063
2018/0369997 A1 * 12/2018 Chen ..... B25B 13/14

* cited by examiner

*Primary Examiner* — David B. Thomas
(74) *Attorney, Agent, or Firm* — Muncy, Geissler, Olds & Lowe, P.C.

(57) ABSTRACT

An adjustable ratchet wrench includes a wrench body, a ratchet, a positioning member, and a movable device. A fixed clamp portion is disposed on the inner periphery of the ratchet. The positioning member is disposed on the inner periphery of the ratchet. The movable device is disposed on the inner periphery of the ratchet and movably connected with the positioning member. The movable device has a movable clamp portion, which forms a tool receiving hole with the fixed clamp portion for receiving a workpiece. By used of the movable device, the size of the tool receiving hole is adjusted for being applicable to workpieces with different sizes, facilitating the utility of the present invention.

16 Claims, 10 Drawing Sheets

ADJUSTABLE RATCHET WRENCH

BACKGROUND OF THE INVENTION

1. Field of the Invention

The present invention relates to ratchet wrench structures, and more particularly, to a ratchet wrench adjustable according to workpieces with different sizes.

2. Description of the Related Art

An ordinary ratchet wrench includes a handle and a head portion, and the head portion further includes a hollow operation portion. During operation, the hollow operation portion of the head portion is mounted around a screw member, and the handle is driven to rotate the head portion, such that the screw member is rotated to be fastened or loosened.

However, size of the hollow operation portion is usually fixed. Such a ratchet wrench is only applicable to the screw members with certain size. Therefore, when screw members with different sizes are to be fastened or loosened, a plurality of wrenches with corresponding tool receiving sizes are needed, causing an inconvenience of usage.

For improving the issues, U.S. Pat. No. 4,838,132 discloses an adjustable wrench tool, which includes an adjustable bolt in the hollow operation portion of the head portion, with one end of the adjustable bolt contacting the target screw member. By adjusting the protruding status of the adjustable bolt, the size the hollow operation portion changes.

However, the wrench tool above does not includes a ratchet structure. In a relatively limited operational space, the operation angle thereof is also limited. After each wrenching step, the wrench needs to be extracted back to the original position for facilitating the next wrenching step, failing to achieve a fast fastening or loosening function and causing an operational difficulty.

SUMMARY OF THE INVENTION

For improving the issues above, an adjustable ratchet wrench is disclosed. By use of a movable device which is movably connected with two positioning members, when the workpiece is received by the tool receiving hole, the movable device moves with respect to the two positioning members for adjusting the size of the tool receiving hole according to the sizes of workpieces, such that the ratchet is allowed to be rotated for fastening or loosening the workpiece after the size of the tool receiving hole is adjusted. With such configuration, the ratchet wrench in accordance with the embodiment of the present invention is applied for fast fastening or loosening different workpieces with different sizes without limitation of operational space, achieving the convenience of usage.

An adjustable ratchet wrench in accordance with an embodiment of the present invention comprises:

a wrench body having a head portion and a handle portion, the head portion comprising a first housing space and a second housing space connected with the first housing space, the first housing space provided with a rotation axis;

a ratchet rotatably disposed in the first housing space around the rotation axis, a plurality of ratchet teeth disposed at an outer periphery of the ratchet, a fixed clamp portion disposed at an inner periphery of the ratchet;

two positioning members disposed at two sides of the inner periphery of the ratchet, respectively;

a movable device disposed at the inner periphery of the ratchet and between the two positioning members, the movable device comprising a movable clamp portion, a tool receiving hole formed between the movable clamp portion and the fixed clamp portion for receiving a workpiece, the movable device switched among a first status, a second status, and a third status; in the first status, the movable device is engaged with the two positioning members; in the second status, the movable device moves with respect to the two positioning members along a direction in parallel to the rotation axis; in the third status, the movable device slides with respect to the two positioning members along a direction in vertical to the rotation axis for adjusting a size of the tool receiving hole; and a restoring device disposed between the movable device and the ratchet, the restoring device enabling the movable device to be switched from the second status to the first status.

With the movable device movably connected with the positioning member, when the workpiece is received in the tool receiving hole, the movable device moves with respect to the positioning members for adjusting the size of the tool receiving hole according to the size of the workpiece. After the size of the tool receiving hole is adjusted, the handle portion is wrenched for fastening or loosening the workpiece. Therefore, the inconvenience of a traditional ratchet wrench which is applicable to a single-sized workpiece is resolved. Also, a fast fastening or loosening function is achieved, increasing the utility and convenience of usage.

In another embodiment of the present invention, each of the two positioning members comprises a first engagement portion, and the movable device comprises second engagement portion corresponding to each first engagement portion. When the movable device is in the first status, each second engagement portion is engaged with each corresponding first engagement portion, wherein each first engagement portion has a first tooth strip, and each second engagement portion has a second tooth portion. The first tooth strip is geared with the corresponding second tooth strip. Each first tooth strip has a plurality of first teeth and a plurality of second teeth. The interval between each first tooth is greater than the interval between each second tooth for facilitating the adjustment of the workpiece size formed according to metric system or Imperial system units. Therefore, the application range of the present invention is improved.

DETAILED DESCRIPTION OF THE INVENTION

Figure 1:
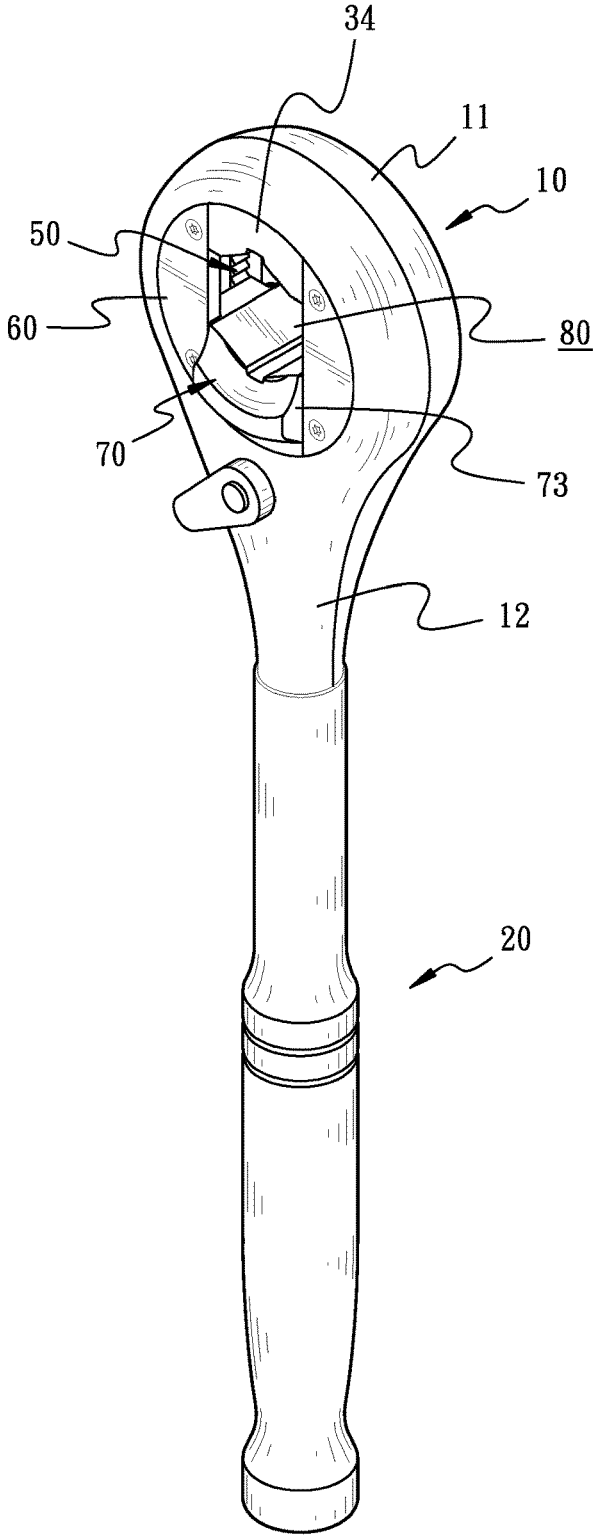
FIG. 1 is a perspective view of the adjustable ratchet wrench in accordance with a first embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring FIG. 1 to FIG. 8, an adjustable ratchet wrench in accordance with an embodiment of the present invention comprises a wrench body 10, a ratchet 30, a ratchet device 40, two positioning members 50, and a movable device 70.

The wrench body 10 has a head portion 11 and a handle portion 12, and the handle portion 12 is connected with a handgrip 20. In an embodiment of the present invention, the wrench body 10 includes a first body 10*a* and a second body 10*b*, with the inner lateral side of the first body 10*a* and the inner lateral side of the second body 10*b* facing each other, such that the head portion 11 is formed of the first body 10*a* and the second body 10*b*. Also, the inner sides of both the first body 10*a* and the second body 10*b* have a first housing space 13 passing therethrough and a second housing space 14 concavely disposed therein, respectively. The first housing space 13 and the second housing space 14 are connected. The second housing space 14 is disposed in adjacent to the handle portion 12. The first housing space 13 is provided with a rotation axis L.

The ratchet 30 is rotatably disposed in the first housing space 13 around the rotation axis L. The ratchet 30 includes a receiving face 31 and an installation face 32 disposed on two opposite sides of the ratchet 30 and facing two ends of the rotation axis L, respectively. The ratchet 30 is disposed between the first body 10*a* and the second body 10*b*, wherein the inner side of the first body 10*a* and the inner side of the second body 10*b* face the receiving face 31 and the installation face 32, respectively. Also, a plurality of ratchet teeth 33 are disposed on the outer periphery of the ratchet 30, and a fixed clamp portion 34 is disposed on the inner periphery of the ratchet 30.

The ratchet device 40 is disposed in the second housing space 14 for gearing the ratchet teeth 33. When the handgrip 20 is wrenched to rotate, the ratchet teeth 33 of the ratchet 30 are geared with the ratchet device 40, such that the ratchet 30 is driven to rotate. In an embodiment of the present invention, the ratchet device 40 is allowed to change the rotation direction of the ratchet 30.

The two positioning members 50 are disposed on two sides of the inner periphery of the ratchet 30. Each positioning member 50 has a transversely disposed first engagement portion 51 facing the rotation axis L. Each first engagement portion 51 includes two convexly disposed first tooth strips 52, wherein the two first tooth strips 52 are spaced and arranged in parallel to the radial direction of the rotation axis L.

The first tooth strip 52 includes a plurality of teeth, wherein the teeth are allowed to be spaced with equal or unequal intervals. In an embodiment of the present invention, the teeth include first teeth 521 and second teeth 522. The interval between the first teeth 521 is greater than the interval between the second teeth 522. Each first tooth 521 and second tooth 522 is allowed to be formed in, for example but not limited to, a sawtooth, rectangular tooth, or wave tooth shape.

The two positioning members 50 are allowed to be integrally formed with the ratchet 30 or installed on the inner periphery of the ratchet 30. In the first embodiment of the present invention, the positioning members 50 are combined to the ratchet 30, wherein the ratchet 30 includes two containing grooves 35 disposed in parallel to the rotation axis L for housing a positioning member 50 therein, respectively. The two positioning members 50 are able to be engaged with the two containing grooves 35. The installation face 32 of the ratchet 30 is connected with two block members 60, so as to fix the two positioning members 50 between the two block members 60 and the ratchet 30.

Further, regarding each positioning member 50, a first protrusion 53 is disposed on one lateral side of the positioning member 50 facing the receiving face 31, and a second protrusion 54 is disposed on another lateral side of the positioning member 50 facing the installation face 32. Each containing groove 35 has a first recess 36 concavely disposed for engaging the first protrusion 53 of the corresponding positioning member 50. Each of the two block members 60 has a second recess 61 concavely disposed on one lateral side of the block member 60 facing the installation face 32 for receiving the second protrusion 54 of the corresponding positioning member 50. As a result, the two positioning members 50 are fixed in the two containing grooves 35.

The movable device 70 is disposed on the inner periphery of the ratchet 30 and movably arranged between the two positioning members 50. The movable device 70 is allowed to be integrally formed or formed of multiple components. In an embodiment of the present invention, the movable device 70 is integrally formed. The movable device 70 is allowed to be switched among a first status, a second status, and a third status. The movable device 70 includes a movable clamp portion 71 formed in a V shape. The movable clamp portion 71 and the fixed clamp portion 34 form a tool receiving hole 80 therebetween for receiving the workpiece 1.

The movable device 70 has two second engagement portions 72 disposed on two sides of the movable device 70 corresponding to the two positioning members 50, respectively, wherein the second engagement portion 72 is allowed to be geared with the corresponding first engagement portion 51. The radial distance between the rotation axis L and the first engagement portion 51 is greater than the radial distance between the rotation axis L and the second engagement portion 72. The second engagement portion 72 includes two second tooth strips 721, wherein the two second tooth strips 721 are spaced and arranged in parallel to the radial direction of the rotation axis L. The first tooth strip 52 is geared with the corresponding second tooth strip 721, and the length of the first tooth strip 52 is greater than the length of the second tooth strip 721. Also, the movable device 70 has a pushing portion 73 disposed on one lateral side of the movable device 70. The height of the pushing portion 73 is greater than the height of the two block members 60, such that the pushing portion 73 protrudes from the outer lateral side of the first body 10*a* through the first housing space 13.

Further, the movable device 70 has a first cave 74, with a restoring device 90 disposed in the first cave 74. Also, the restoring device 90 is disposed between the movable device 70 and the ratchet 30, wherein the restoring device 90 includes a first resilient member 91 and a fixing member 92.

The first resilient member 91 has two ends thereof resting against the first cave 74 and the fixing member 92, respectively. The fixing member 92 is disposed at the opening of the first cave 74 for preventing the first resilient member 91 from detaching from the first cave 74. Also, the fixing member 92 is allowed to move with respect to the first cave 74 due to the tension of the first resilient member 91, such that the first resilient member 91 switches the movable device 70 from the second status to the first status. In the first embodiment of the present invention, two restoring devices 90 are included; two first caves 74 are disposed on a lateral side of the two second engagement portions 72 facing the installation face 32, respectively, for housing the two restoring devices 90, respectively.

Figure 2:
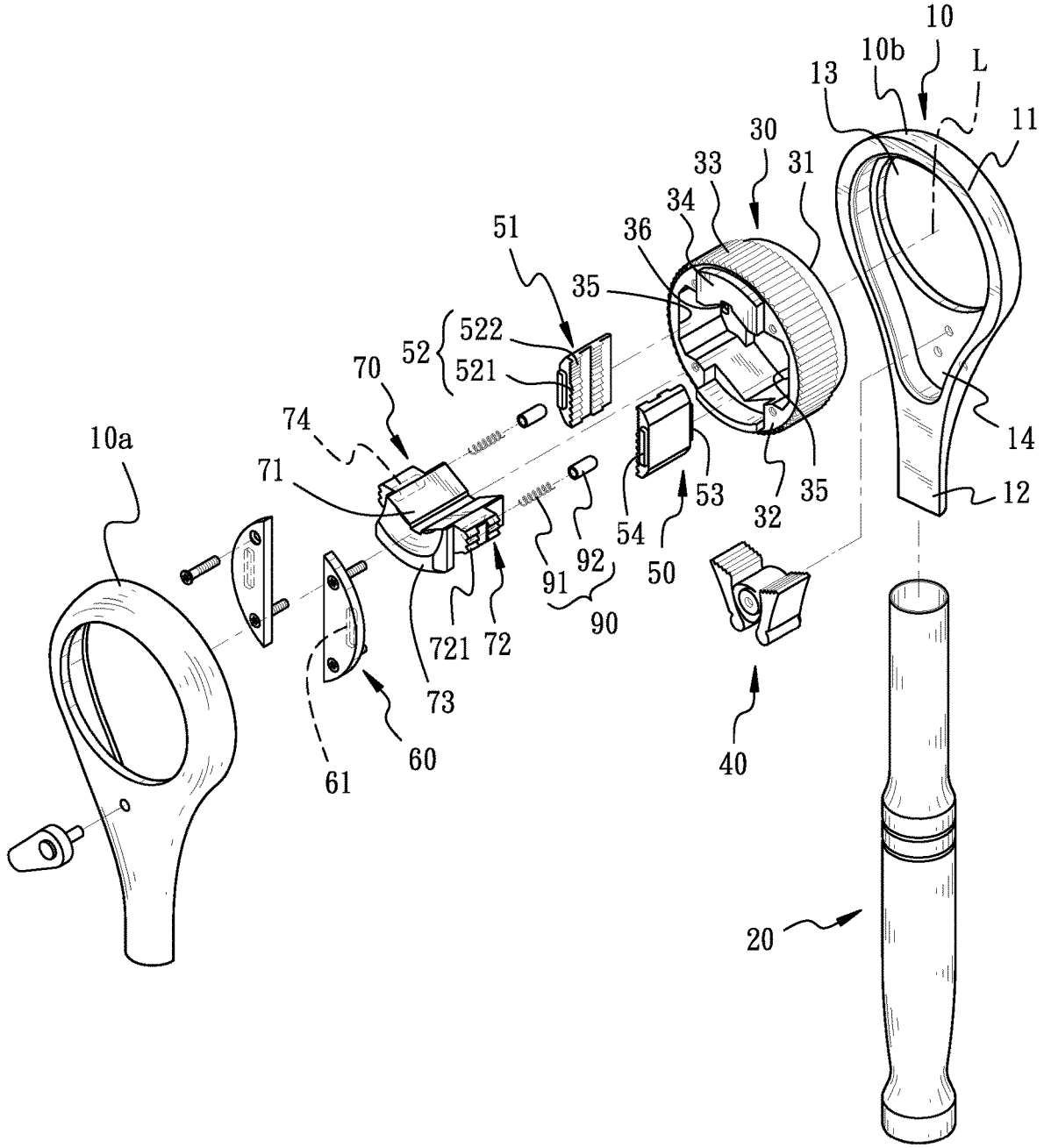
FIG. 2 is an exploded view of the adjustable ratchet wrench in accordance with the first embodiment of the present invention.
Figure 3:
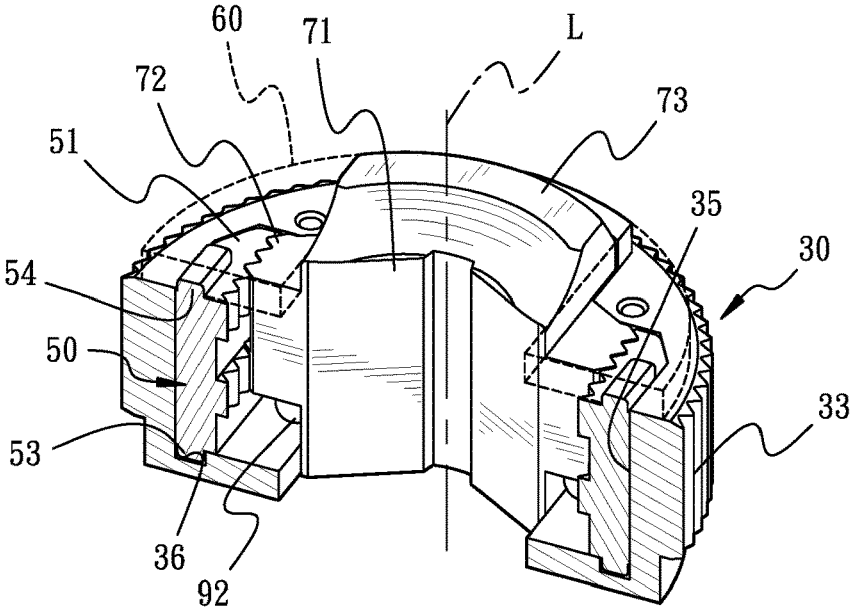
FIG. 3 is a sectional perspective view of the head portion in accordance with the first embodiment of the present invention, illustrating the movable device in the first status.
Figure 4:
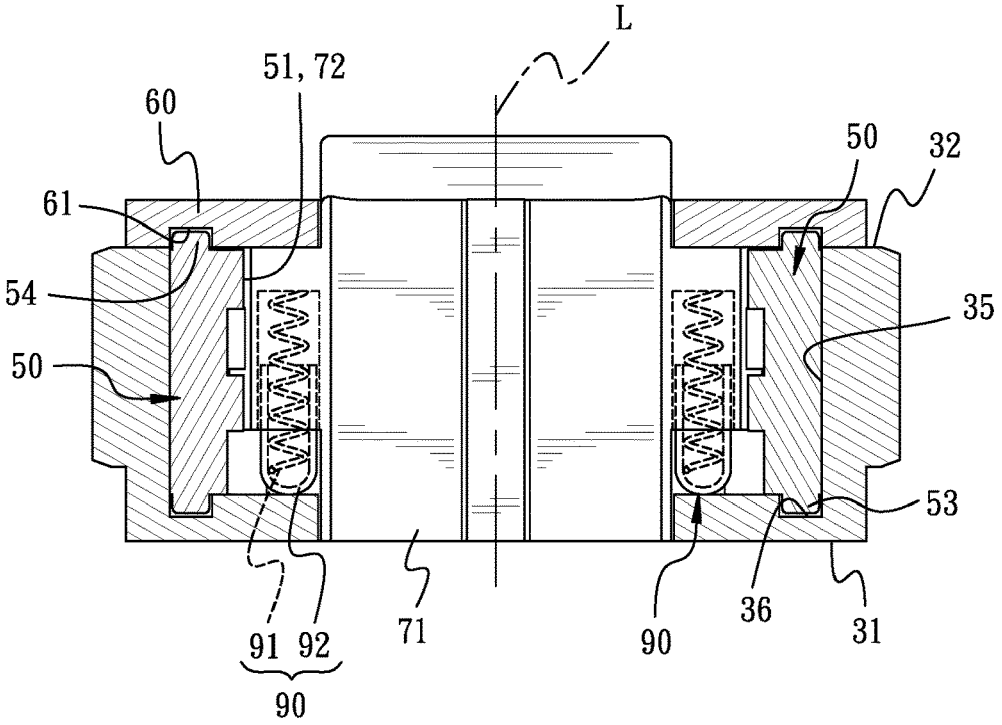
FIG. 4 is a sectional front view of the head portion in accordance with the first embodiment of the present invention, illustrating the movable device in the first status.

Referring to FIG. 2 to FIG. 4, when the movable device 70 is in the first status, the second tooth strip 721 of the second engagement portion 72 is geared with the first tooth strip 52 of the corresponding first engagement portion 51, such that the movable device 70 is engaged with the two positioning members 50.

Figure 5:
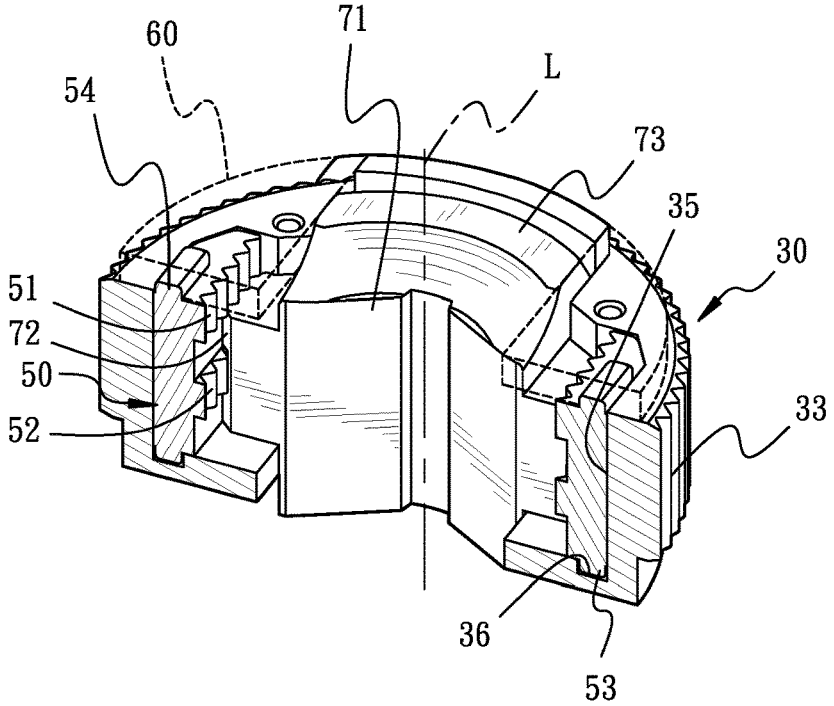
FIG. 5 is a sectional perspective view of the head portion in accordance with the first embodiment of the present invention, illustrating the movable device in the second status.
Figure 6:
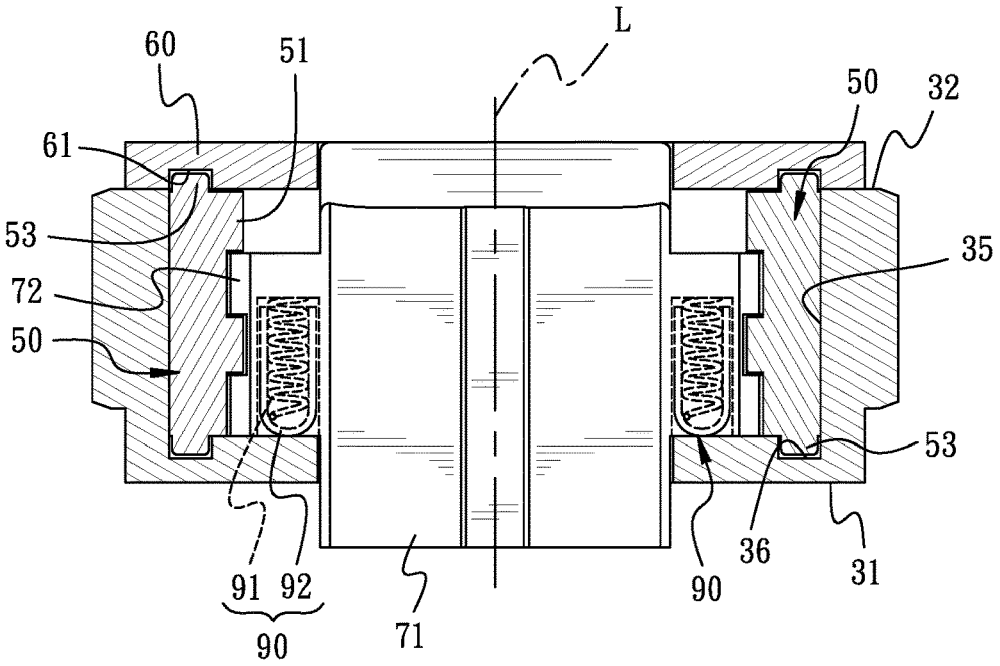
FIG. 6 is a sectional front view of the head portion in accordance with the first embodiment of the present invention, illustrating the movable device in the second status.
Figure 7:
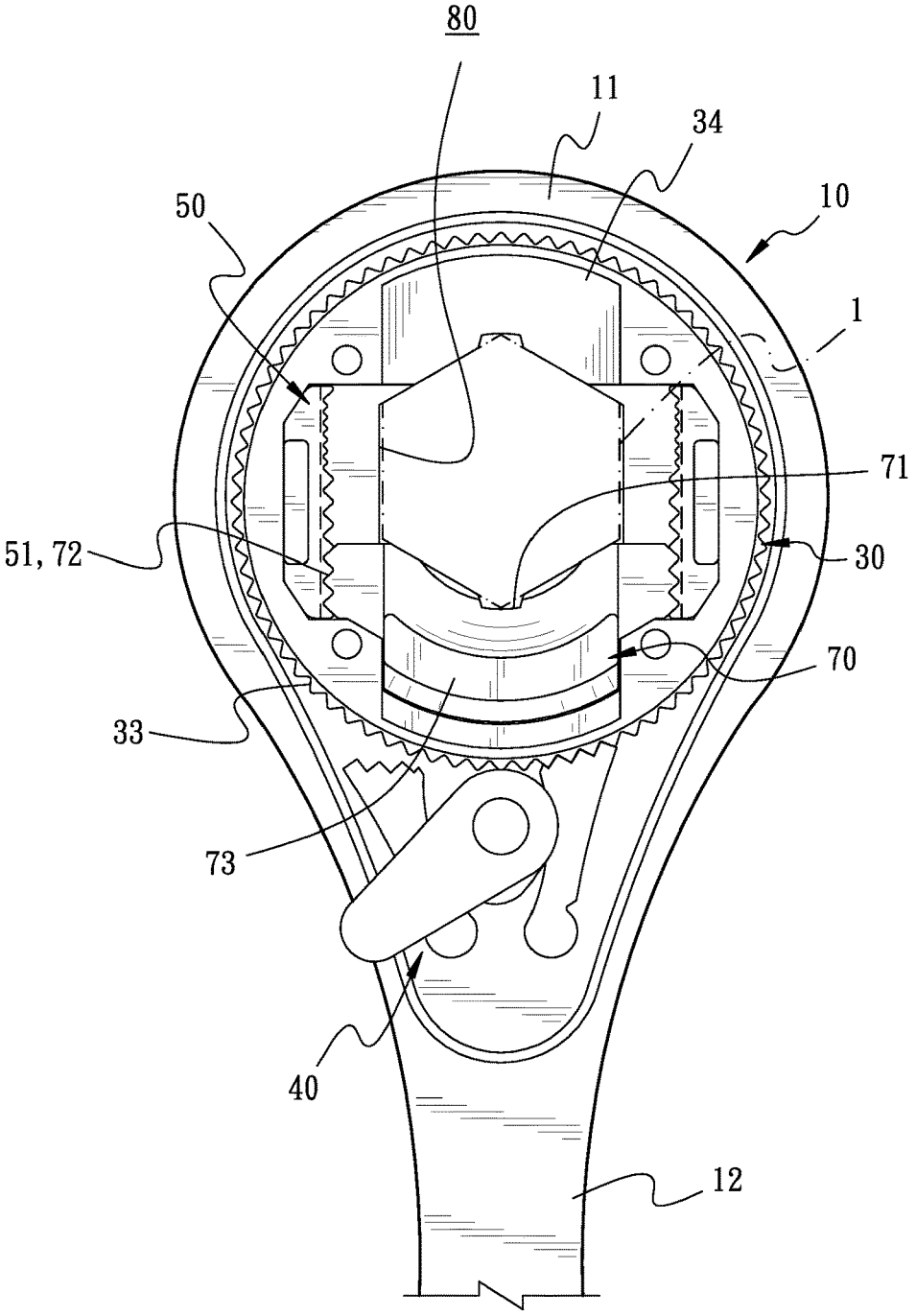
FIG. 7 is a schematic view in accordance with the first embodiment of the present invention, illustrating the tool receiving hole receiving the workpiece.

Referring to FIG. 2, FIG. 5, and FIG. 6, when the movable device 70 is in the second status, the user imposes a force upon the pushing portion 73 along a direction in parallel to the rotation axis L, so as to move the movable device 70 toward the force imposing direction, so as to remove the gearing engagement between the second tooth strip 721 of the second engagement portion 72 and the first tooth strip 52 of the first engagement portion 51. Subsequently, the user is allowed to switch the movable device 70 from the second status to the third status.

Figure 8:
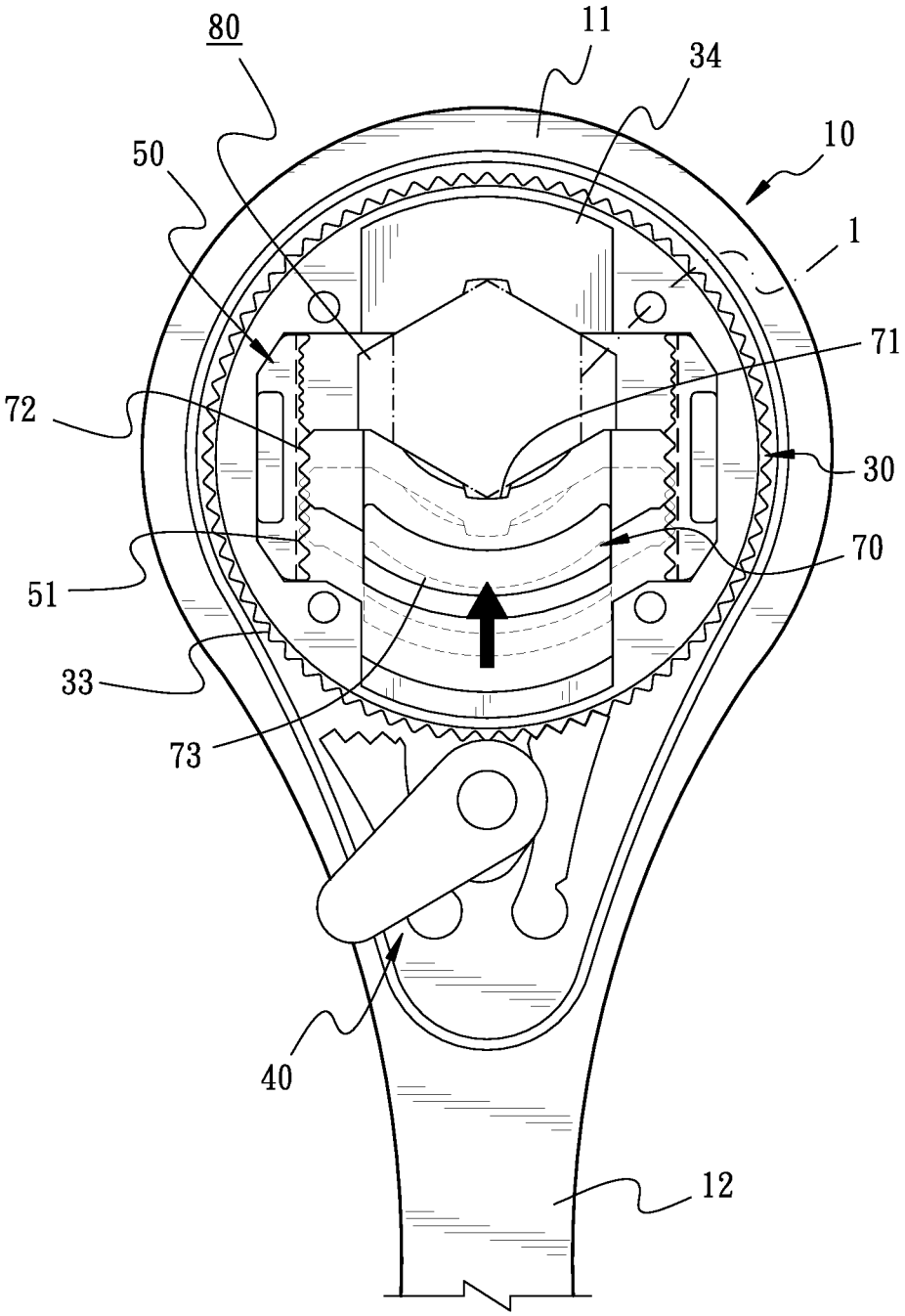
FIG. 8 is a schematic view in accordance with the first embodiment of the present invention, illustrating the movable device in the third status for adjusting the size of the tool receiving hole according to a different sized workpiece.

Referring to FIG. 2 and FIG. 8, during the third status of the movable device 70, the user is able to impose a force upon the pushing portion 73 along a direction in vertical to the rotation axis L. As the embodiment shown in FIG. 8, the force imposing direction is defined from the bottom toward the top of the drawing. Therefore, the movable device 70 moves along the force imposing direction, such that one of second tooth strips 721 of the second engagement portion 72 slides between the two first tooth strips 52 of the first engagement portion 51, allowing the adjustment of the size of the tool receiving hole 80. When the size of the tool receiving hole 80 is adjusted, the user removes the force imposed upon the pushing portion 73, such that a prestress of the first resilient member 91 of the restoring device 90 drives the movable device 70 to be switched from the third status to the first status, so as to fix the size of the tool receiving hole 80.

Thus, when the user needs to fasten or loosen the workpiece 1, the tool receiving hole 80 is mounted around the workpiece 1 via the receiving face 31, so as to position one side of the workpiece 1 upon the fixed clamp portion 34. If the size of the tool receiving hole 80 fails to match the size of the workpiece 1, the user is allowed to impose a force upon the pushing portion 73 along a direction in parallel to the rotation axis L, so as to switch the movable device 70 from the first status to the second status. Next, the user impose a force upon the pushing portion 73 along a direction in vertical to the rotation axis L, so as to switch the movable device 70 to the third status for adjusting the size of the tool receiving hole 80 to a size matching the size of the workpiece 1. Therefore, the workpiece 1 is able to be clamped by the fixed clamp portion 34 and the movable clamp portion 71. Then, the restoring device 90 restores the movable device 70 from the third status to the first status for fixing the size of the adjusted tool receiving hole 80. Next, the user is able to wrench the handgrip 20 for driving the ratchet 30 to rotate, so as to fasten or loosen the workpiece 1.

With the movable device 70 movably connected with the two positioning members 50, the size of the tool receiving hole 80 is adjusted according to the size of the workpiece 1 for facilitating the fastening or loosening operation of the workpiece 1 by rotating the ratchet 30. Therefore, the present invention is applicable to workpieces 1 with different sizes, achieving the convenience of usage.

In addition, the interval between the first teeth 521 and the interval between the second teeth 522 of the positioning members 50 are different. In the embodiment of the present invention, the first teeth 521 and the second teeth 522 facilitate the adjustment in both the metric system and Imperial system units. Therefore, the present invention is applicable to workpieces 1 in both metric system and Imperial system unit specifications. The application range of the present invention is enlarged.

Referring to FIG. 9 to FIG. 13, the adjustable ratchet wrench in accordance with the second embodiment of the present invention is illustrated, wherein the numeric of the identical components are omitted. The differences of the second embodiment are described as following.

In the second embodiment of the present invention, the movable device 70 includes a slider 75, a control member 76, two operation members 77, and two pushing structures 78. The slider 75 includes an installation space 751. The movable clamp portion 71 is disposed on one outer lateral side of the slider 75 facing the rotation axis L. The slider 75 has a bottom face 752 disposed in the installation space 751, with a connection portion 753 protruding from the bottom face 752.

The control member 76 is disposed in the installation space 751 between the two operation members 77. A resting face 761 is disposed on the control member 76 facing the bottom face 752, with a combination groove 762 concavely disposed on the resting face 761. The connection portion 753 is engaged with the combination groove 762, such that the control member 76 and the slider 75 are engaged with each other. Also, the pushing portion 73 is disposed on one side of the control member 76 away from the resting face 761. Two connection faces 763 are disposed on the control member 76 between the resting face 761 and the pushing portion 73, wherein the connection faces 763 are formed in a bevel shape, respectively. Also, the two connection faces 763 expand and incline from the pushing portion 73 toward the resting face 761. Additionally, two first caves 74 are concavely formed on the resting face 761, and each first cave 74 includes a restoring device 90.

The two operation members 77 are disposed in the installation space 751. Each operation member 77 has an incline contact face 771. Two contact faces 771 taper and incline along a direction from the pushing portion 73 toward the resting face 761. Also, two connection faces 763 and the two contact faces 771 are inclined to be geared with each other, respectively.

Furthermore, the two operation members 77 are connected with the two positioning members 50, respectively. Each operation member 77 has a second engagement portion 72 disposed on one side of the operation member 77 opposite to the contact face 771. The radial distance between the rotation axis L and the first engagement portion 51 is greater than the radial distance between the rotation axis L and the second engagement portion 72. The first engagement portion 51 of each positioning member 50 has two first tooth strips 52, wherein the two first tooth strips 52 are spaced and arranged in parallel to the radial direction of the rotation axis L. The second engagement portion 72 of each operation member 77 has a second tooth strip 721.

Each pushing structure 78 is disposed between the one of the operation members 77 and the corresponding positioning member 50. Also, the second engagement portion 72 of each operation member 77 has a concavely disposed second cave 722, such that the pushing structure 78 is disposed in the corresponding second cave 722. The pushing structure 78 includes a second resilient member 781 and a sliding member 782. The second resilient member 781 has two ends thereof resting against the corresponding second cave 722 and the sliding member 782.

Figure 9:
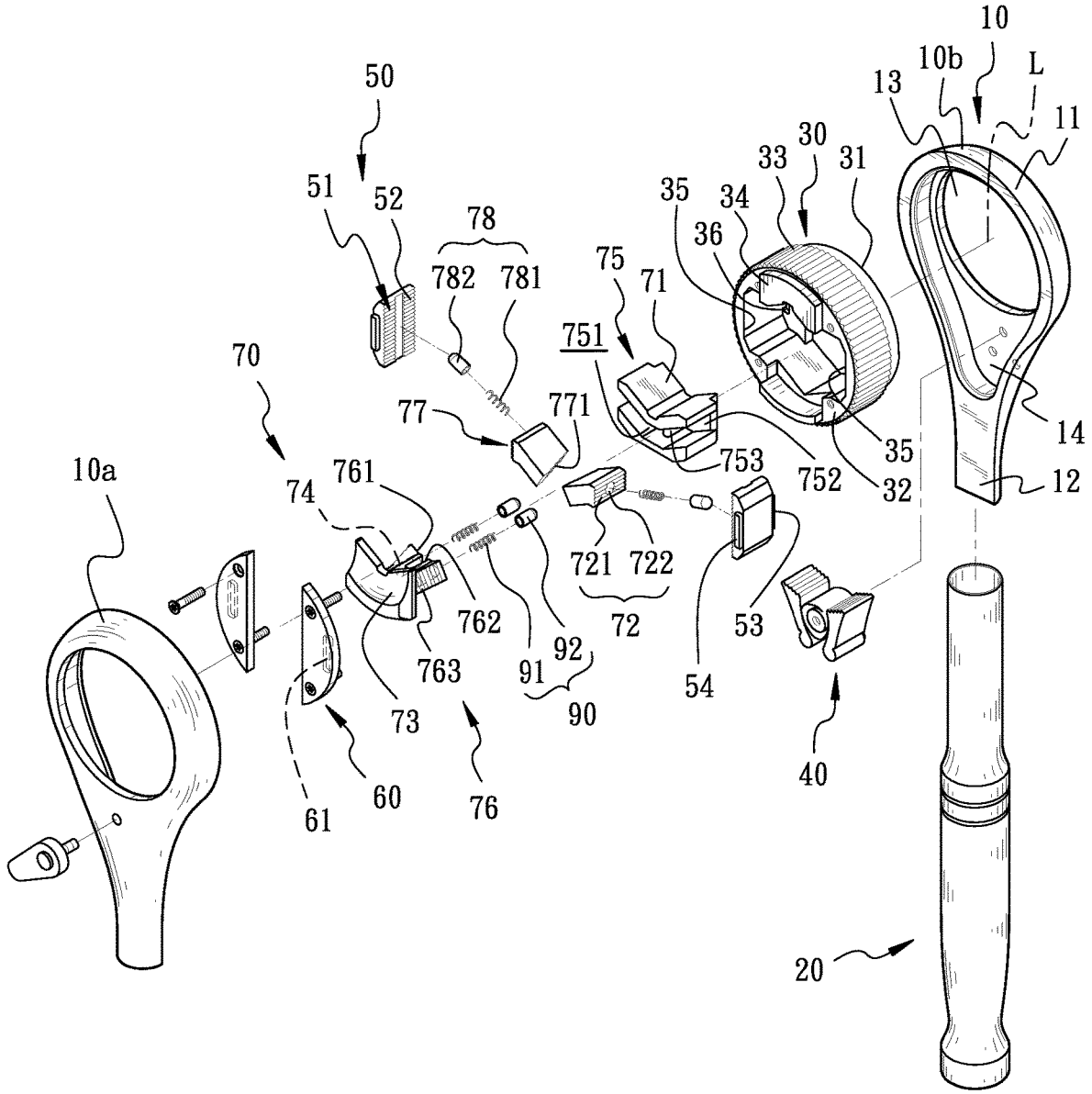
FIG. 9 is an exploded view of the adjustable ratchet wrench in accordance with the second embodiment of the present invention.
Figure 10:
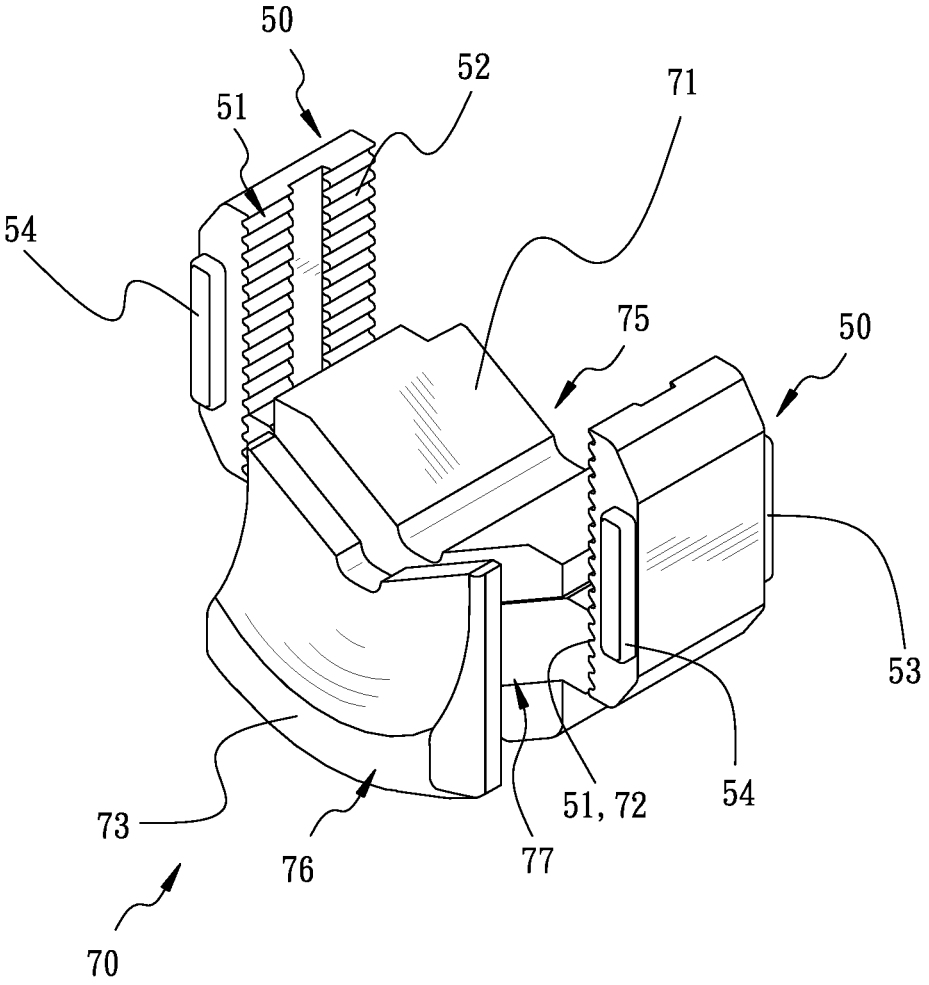
FIG. 10 is a perspective view of the adjustable ratchet wrench in accordance with the second embodiment of the present invention, illustrating the movable device connected with the two positioning members.
Figure 11:
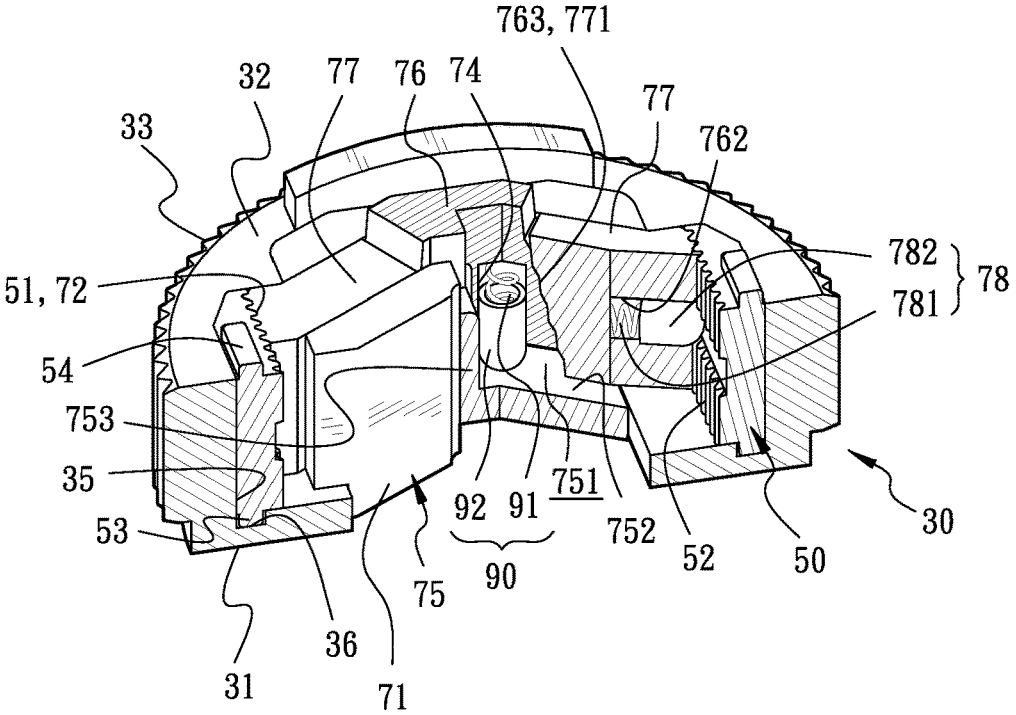
FIG. 11 is a sectional perspective view of the head portion in accordance with the second embodiment of the present invention, illustrating the movable device in the first status.

Referring to FIG. 9 and FIG. 11, when the movable device 70 is in the first status, the second tooth strip 721 of the two operation members 77 are geared with the first tooth strip 52 of the two positioning members 50, such that the movable device 70 is engaged with the two positioning members 50, and the sliding member 782 is placed between the two first tooth strips 52 of the corresponding first engagement portion 51.

Figure 12:
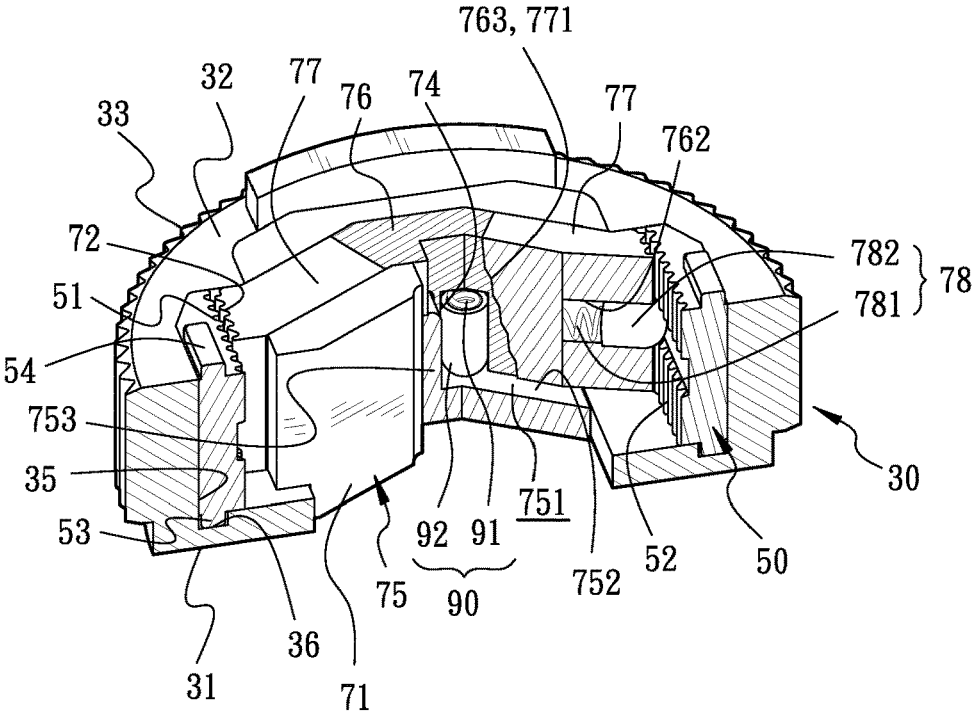
FIG. 12 is a sectional perspective view of the head portion in accordance with the second embodiment of the present invention, illustrating the movable device in the second status.

Referring to FIG. 9 and FIG. 12, when the movable device 70 is in the second status, the user imposes a force upon the pushing portion 73 along the direction in parallel to the rotation axis L, so as to move the control member 76 in the installation space 751 toward the force imposing direction. When the control member 76 moves toward the force imposing direction, a gap is produced due to the incline arrangement between the connection face 763 and the contact face 771, and the prestress of the second resilient member 781 of the pushing structure 78 offsets the gap. As a result, the operation member 77 moves along the radial direction of the rotation axis L, such that the operation members 77 is separated from the corresponding positioning member 50, and the second tooth strip 721 of the operation member 77 is prevented from gearing the first tooth strip 52 of the positioning member 50. Next, the user is able to switch the movable device 70 from the second status to the third status.

Figure 13:
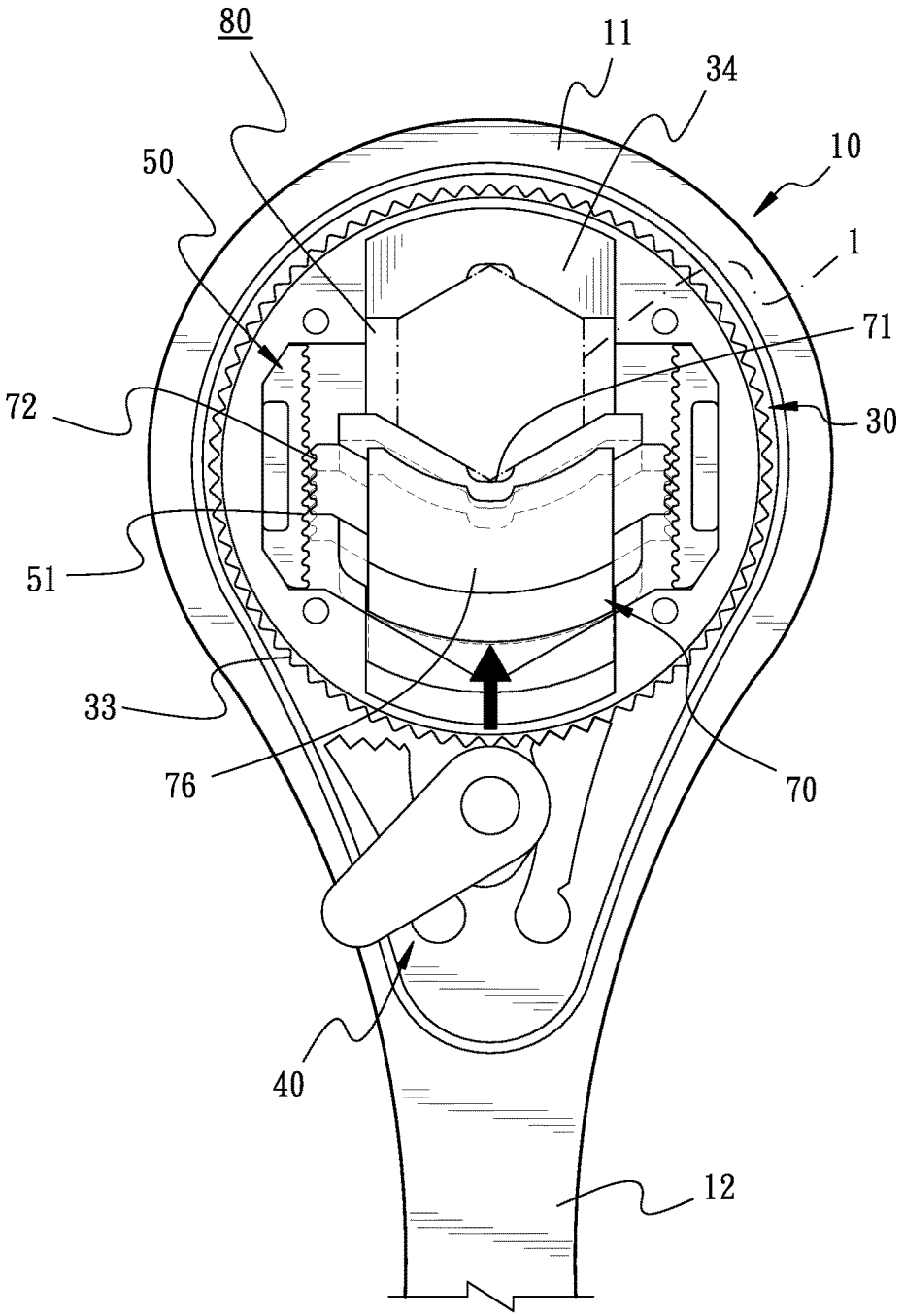
FIG. 13 is a schematic view of the second embodiment of the present invention, illustrating the movable device in the third status for adjusting the size of the tool receiving hole according to a different sized workpiece.

Referring to FIG. 9 and FIG. 13, the user imposes a force upon the pushing portion 73 along the direction in vertical to the rotation axis L, such that the control member 76 drives the slider 75 to move along the force imposing direction. When the slider 75 moves, the sliding member 782 slides between the two first tooth strips 52 of the first engagement portion 51 for adjusting the size of the tool receiving hole 80. When the size of the tool receiving hole 80 is adjusted, the user removes the force imposed upon the pushing portion 73, such that a prestress of the first resilient member 91 of the restoring device 90 drives the movable device 70 to be switched from the third status to the first status, so as to fix the size of the tool receiving hole 80.

In the second embodiment of the present invention, the movable device 70 is formed of the slider 75, the control member 76, the two operation members 77, and the two pushing structures 78. Therefore, the manufacturing difficulty and cost of the overall movable device 70 are lowered, thus improving the manufacturing quality and efficiency.

Furthermore, when the movable device 70 is in the second and third status, the two operation member 77 do not contact the two positioning members 50. Therefore, when the force imposed upon the movable device 70 is removed after the size of the tool receiving hole 80 being adjusted, the restoring device 90 efficiently restores the movable device 70 back to the position before the user imposing the force, and the control member 76 thus drives the two operation members 77 to be geared with the two positioning members 50. Therefore, the size of the tool receiving hole 80 is effectively adjusted.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adjustable ratchet wrench, comprising:

a wrench body having a head portion and a handle portion, the head portion comprising a first housing space and a second housing space connected with the first housing space, the first housing space provided with a rotation axis;

a ratchet rotatably disposed in the first housing space around the rotation axis, a plurality of ratchet teeth disposed at an outer periphery of the ratchet, a fixed clamp portion disposed at an inner periphery of the ratchet;

two positioning members disposed at two sides of the inner periphery of the ratchet, respectively;

a movable device disposed at the inner periphery of the ratchet and between the two positioning members, the movable device comprising a movable clamp portion, a tool receiving hole formed between the movable clamp portion and the fixed clamp portion for receiving a workpiece, the movable device being switched among a first status, a second status, and a third status; in the first status, the movable device is engaged with the two positioning members; in the second status, the movable device moves with respect to the two positioning members along a direction in parallel to the rotation axis; in the third status, the movable device slides with respect to the two positioning members along a direction in vertical to the rotation axis for adjusting a size of the tool receiving hole; and a restoring device disposed between the movable device and the ratchet, the restoring device enabling the movable device to be switched from the second status to the first status.

2. The adjustable ratchet wrench of claim 1, wherein each of the two positioning members has a first engagement portion facing the rotation axis, the movable device has two second engagement portions corresponding to the two first engagement portions; when the movable device is in the first status, each second engagement portion is engaged with the corresponding first engagement portion.

3. The adjustable ratchet wrench of claim 2, wherein each first engagement portion has a first tooth strip disposed along a radial direction of the rotation axis, and each second engagement portion has a second tooth strip disposed along the radial direction of the rotation axis, such that the first tooth strip is geared with the second tooth strip, and a length of each first tooth strip is greater than a length of each second tooth strip.

4. The adjustable ratchet wrench of claim 3, wherein each first tooth strip has a plurality of first teeth and a plurality of second teeth, and an interval between the first teeth is greater than an interval between the second teeth.

5. The adjustable ratchet wrench of claim 4, wherein two first tooth strips and two second tooth strips are included; the two first tooth strips are spaced and arranged in parallel to the radial direction of the rotation axis, and the two second tooth strips are spaced and arranged in parallel to the radial direction of the rotation axis; when the movable device is in the second status, the two first tooth strips are not geared with the two second tooth strips; when the movable device is in the third status, one of the second tooth strips slides between the two first tooth strips.

6. The adjustable ratchet wrench of claim 1, wherein the ratchet comprises two containing grooves for housing the two positioning members, respectively, such that the two positioning members are fixed between the two containing grooves and two block members, respectively.

7. The adjustable ratchet wrench of claim 6, wherein the ratchet comprises a receiving face and an installation face facing two ends of the rotation axis, respectively; each of the two positioning members has a first protrusion disposed on one lateral side of the positioning member facing the receiving face; each of the two positioning members has a second protrusion disposed on one lateral side of the positioning member facing the installation face; each of the containing grooves has a concavely disposed first recess corresponding to each of the first protrusion, such that the two first protrusions are engaged with the two first recesses, respectively; each of the two block members has a second recess concavely disposed on one lateral side of the block member facing the installation face, such that the two second protrusions are engaged with the two second recesses, respectively.

8. The adjustable ratchet wrench of claim 7, wherein the wrench comprises a first body and a second body combined together, the first body and the second body facing the installation face and the receiving face, respectively, with the ratchet disposed between the first body and the second body; a pushing portion of the movable device arranged to protrude between the two block members and protrude from an outer lateral side of the first body.

9. The adjustable ratchet wrench of claim 7, wherein two restoring devices are included, and the movable device comprises two concave first caves disposed on a lateral side of the movable device facing the installation face, respectively, for housing the two restoring devices; each of the restoring devices comprises a first resilient member and a fixing member, with two ends of the resilient member resting against the corresponding first cave and the corresponding fixing member, such that a prestress of the first resilient member switches the movable device from the second status to the first status.

10. The adjustable ratchet wrench of claim 1, wherein the movable device comprises a slider, a control member, and two operation members, the slider having an installation space, with the movable clamp portion disposed on one outer lateral side of the slider facing the rotation axis; the control member and the two operation members disposed in the installation space, the control member placed between the two operation members, the two operation members being connected with the two positioning members, respectively, with a pushing structure disposed between each operation member and the corresponding positioning member; when the movable device is in the first status, the two operation members are engaged with the two positioning member; when the movable device is in the second status, the control member moves along a direction in parallel to the rotation axis, and the two pushing structures force the two operation members to move along a radial direction of the rotation axis, such that the two operation members and the two positioning members are separated.

11. The adjustable ratchet wrench of claim 10, wherein the control member comprises two connection faces, each of the two operation members comprises a contact face, and the two connection faces and the two contact faces incline to contact each other, respectively; each of the two pushing structure comprises a second resilient member, with two ends of the resilient member resting against the corresponding positioning member and the corresponding operation member; when the movable device is in the second status, the control member moves along the direction in parallel to the rotation axis, and the two operation members move along the radial direction of the rotation axis, such that the two operation members and the two positioning members are separated.

12. The adjustable ratchet wrench of claim 11, wherein the two connection faces and the two contact faces are inclined to be geared with each other, respectively.

13. The adjustable ratchet wrench of claim 10, wherein each of the two positioning members comprises a first engagement portion facing the rotation axis, and each of the operation members comprises a second engagement portion corresponding to each first engagement portion; when the movable device is in the first status, each second engagement portion is engaged with the corresponding first engagement portion.

14. The adjustable ratchet wrench of claim 13, wherein each first engagement portion is disposed along the radial direction of the rotation axis, each second engagement portion is disposed along the radial direction of the rotation axis, and a radial distance between the rotation axis and each first engagement portion is greater the a radial distance between the rotation axis and each second engagement portion.

15. The adjustable ratchet wrench of claim 14, wherein each first engagement portion comprises two first tooth strips, each second engagement portion comprises a second tooth strip, and the two first tooth strips are spaced and disposed in parallel to the radial direction of the rotation axis; when the movable device is in the first status, the first tooth strips are geared with the second tooth strip; when the movable device is in the second and third status, the first tooth strips are not geared with the second tooth strip.

16. The adjustable ratchet wrench of claim 15, wherein the second engagement portion of each operation member comprises a concave second cave; each pushing structure comprises a sliding member, and two ends of the second resilient member rests against the corresponding second cave and the corresponding fixing member; when the movable device is in the third status, the sliding member slides between the corresponding first engagement portion and the corresponding two first tooth strips.

* * * * *